US010024045B2

(12) United States Patent
Clary

(10) Patent No.: US 10,024,045 B2
(45) Date of Patent: Jul. 17, 2018

(54) DRILL BIT

(71) Applicant: Wayne Lee Clary, Griswold, IA (US)

(72) Inventor: Wayne Lee Clary, Griswold, IA (US)

( * ) Notice: Subject to any disclaimer, the term of this patent is extended or adjusted under 35 U.S.C. 154(b) by 0 days.

(21) Appl. No.: 15/586,238

(22) Filed: May 3, 2017

(65) Prior Publication Data

US 2017/0328053 A1 Nov. 16, 2017

Related U.S. Application Data

(60) Provisional application No. 62/336,294, filed on May 13, 2016.

(51) Int. Cl.

| | |
|---|---|
| ***E03F 9/00*** | (2006.01) |
| ***E03C 1/302*** | (2006.01) |
| ***B08B 9/045*** | (2006.01) |
| ***B08B 9/043*** | (2006.01) |

(52) U.S. Cl.

CPC ..... *E03F 9/005* (2013.01); *B08B 9/045* (2013.01); *B08B 9/0436* (2013.01); *E03C 1/302* (2013.01)

(58) Field of Classification Search

CPC .. E03C 1/30; E03C 1/302; E03F 9/002; E03F 9/005; B08B 9/04; B08B 9/043; B08B 9/0436; B08B 9/045

USPC ..... 15/104.05, 104.09, 104.095, 15/104.31–104.33

See application file for complete search history.

(56) References Cited

U.S. PATENT DOCUMENTS

| | | | | | |
|---|---|---|---|---|---|
| 397,769 | A * | 2/1889 | Wright | B08B 9/045 | 15/104.09 |
| 650,451 | A * | 5/1900 | Byers | B08B 9/0436 | 15/104.16 |
| 2,637,866 | A * | 5/1953 | Kiesler, Sr. | E03F 9/002 | 15/104.33 |
| 2,756,447 | A * | 7/1956 | Hogan | E03F 9/002 | 15/104.095 |
| 2,786,218 | A * | 3/1957 | Yousem | E03C 1/302 | 15/104.33 |
| 2,801,432 | A * | 8/1957 | Randrup | B08B 7/024 | 15/104.011 |
| 8,505,146 | B1 * | 8/2013 | Jessup | E03F 9/005 | 15/104.03 |

FOREIGN PATENT DOCUMENTS

| | | | |
|---|---|---|---|
| DE | 2510487 | * | 9/1976 |
| DE | 3427167 | * | 2/1986 |
| DE | 202014006328 | * | 8/2014 |
| FR | 2479035 | * | 10/1981 |
| GB | 14294 | * | 5/1913 |
| GB | 23604 | * | 10/1914 |

* cited by examiner

*Primary Examiner* — Mark Spisich
(74) *Attorney, Agent, or Firm* — RG Patent Consulting, LLC; Rachel Gilboy

(57) ABSTRACT

An improved drill bit is a drill bit designed for use with a drain snake unclogging apparatus for sewer pipes having an arrowhead shaped point attached to a short drill bit sized for sewer pipes and having helical grooves along its length for material that has been cut or loosened by the pointed chisel bit to move rearward through the grooves away from the clogged material. The bit is more effective for solid plugs within a pipeline in that it cuts the clogging material into pieces instead of being design for gripping and pulling the clog.

16 Claims, 5 Drawing Sheets

DRILL BIT

CROSS-REFERENCE TO RELATED APPLICATION

The present application is related to and claims priority from prior provisional application Ser. No. 62/336,294, filed May 13, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of drain unclogging devices, and more specifically, relates to an improved drill bit for use with sewer pipes.

2. Description of the Related Art

Sewer lines will create problems when blocked by tree roots, hair and household debris. When cleaning out the trap and plunging the line to clear the blockage does not open the line, consumers generally try to use a drain auger (also known as a snake) to clear the obstruction. This tool is a flexible rod within a stiff coiled wire that's usually about ¼-inch thick with a handle on the proximal end for rotating the flexible rod within the wire coil and the attached spiral bit on the distal end of the flexible rod. The snake is pushed into the clog, and the handle on the snake is cranked around to drive the snake further into the obstruction. The ends of the snakes may appear to be cutters designed to cut a path through the debris, a cork-screw-like spiral to grip and pull the debris, or a chisel bit to break the debris into small pieces as it is struck repeatedly. These can be effective for opening drains clogged with hair, garbage and household debris, but will not work as effectively when the blockage is created by concrete, rust or heavy scale build-up. Generally the only alternative when a line cannot be cleared using these methods is to replace the plumbing which is expensive and laborious. Therefore, a need exists for a specially designed bit that is more effective for removing heavy-duty blockages like these.

Various attempts have been made to solve the problems which may be found in related art but have thus far been unsuccessful. None of the related art, taken either singly or in combination, is seen to describe the invention as claimed. Ideally, a drain unclogging devices should provide quick and easy pipe clog clearing, and yet, would operate reliably and be manufactured at a modest expense. Thus, a need exists for a reliable an improved drill bit for use with sewer pipes to avoid the above-mentioned problems.

BRIEF SUMMARY OF THE INVENTION

In view of the foregoing disadvantages inherent in the known drain unclogging device art, the present invention provides a novel an improved drill bit for use with sewer pipes. The general purpose of the present invention, which will be described subsequently in greater detail, is to provide speed and ease of clearing an obstruction in a sewer drain line.

An improved drill bit for use with sewer pipes may comprise a main body portion having a spiral groove extending from the top end to the bottom end of the main body portion and is adapted to allow movement of drilled material to move there along and pass rearward away from the top end of the main body portion, a blade member connected to the top end of the main body portion that is adapted to contact and pulverize material, and a connector portion connected to the bottom end of the main body portion that is adapted to releasably attach to the end portion of a cable sewer snake apparatus. The improved drill bit is adapted to be releasably attached to the end portion of a cable sewer snake apparatus and used to pulverize and remove obstructing material blocking flow through a sewer pipe.

The connector portion is formed having an outer diameter that includes threads upon the surface adapted to interdigitate and releasably connect with threads on the end portion of the cable sewer snake apparatus. The connector portion may have female threads within the connector portion to interdigitate with male threads on the end portion of the snake member. The blade member is formed having a diamond-shape having a length and a width and adapted to increase pressure between the blade member and material blocking the sewer pipe. The spiral groove extends around an outer periphery of the main body one time extending from the top end to the bottom end. The spiral groove may extend around the outer periphery of the main body two times extending from the top end to the bottom end, or may extend around the outer periphery three times depending on the embodiment. The improved drill bit preferably is offered in a set comprising all embodiments and may be of different diameters for use in different diameters of pipe.

The main body is formed from a material chosen from the group of materials consisting of iron, steel, and ceramic. The blade member is formed from a material chosen from the group of materials consisting of iron, steel, ceramic, and diamonds. The main body is formed having an outer diameter larger than the outer diameter of the connector portion and larger than the width and the length of the blade member.

An improved cable sewer snake apparatus may comprise a casing member, a handle member attached to the casing member, a crank member rotatably connected to the casing member, and a snake member formed as an elongated and flexible rod-shaped member having an axis defined by its length and adapted to be inserted into sewer pipes. The snake member includes a first end adapted to extend into the casing member and be connected to the handle member and rotate therewith and around its axis. The snake member includes an end portion adapted to releasably connect with a bit member.

An improved drill bit preferably comprises a main body portion including a spiral groove extending from the top end to the bottom end of the main body portion that is adapted to allow movement of material along the groove while drilling, a blade member connected to the top end of the main body portion that is adapted to contact and pulverize material, and a connector portion connected to the bottom end of the main body portion that is adapted to releasably attach to the end portion of the snake member.

The improved drill bit is adapted to be releasably attached to the end portion of the snake member and used to pulverize and remove material blocking a sewer pipe by passing the material along the grooves away from the top end of the main body. The end portion of the snake member may include threads thereon, and the connector portion is formed having an outer diameter and includes threads upon the surface adapted to interdigitate and releasably connect with the threads on the end portion of the snake member. The connector portion may have female threads within the connector portion to interdigitate with male threads on the end portion of the snake member.

The blade member is formed having a diamond-shape having a length and a width and adapted to increase pressure between the blade member and material blocking a sewer pipe. Wherein the spiral groove extends around an outer periphery of the main body one time while extending from a top end to a bottom end thereof, but in other embodiments may extend around the outer periphery two or three times. The improved drill bit preferably is offered in a set comprising all embodiments and may be of different diameters for use in different diameters of pipe. The main body is formed from a material chosen from the group of materials consisting of iron, steel, and ceramic. The blade member is formed from a material chosen from a group of materials consisting of iron, steel, ceramic, and diamonds. The main body is formed having an outer diameter larger than the outer diameter of the connector portion and larger than the width and the length of the blade member.

The present invention holds significant improvements and serves as an improved drill bit for use with sewer pipes. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an improved drill bit for use with sewer pipes, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a drain unclogging device and more particularly to an improved drill bit for use with sewer pipes as used to improve the speed and ease of clearing an obstruction in a sewer drain line.

Generally speaking, an improved drill bit is a drill bit designed for use with a drain snake unclogging apparatus for sewer pipes having an arrowhead shaped point attached to a short drill bit sized for sewer pipes and having helical grooves along its length for material that has been cut or loosened by the pointed chisel bit to move rearward through the grooves away from the clogged material. The bit is more effective for solid plugs within a pipeline in that it cuts the clogging material into pieces instead of being design for gripping an pulling the clog.

Figure 1A:
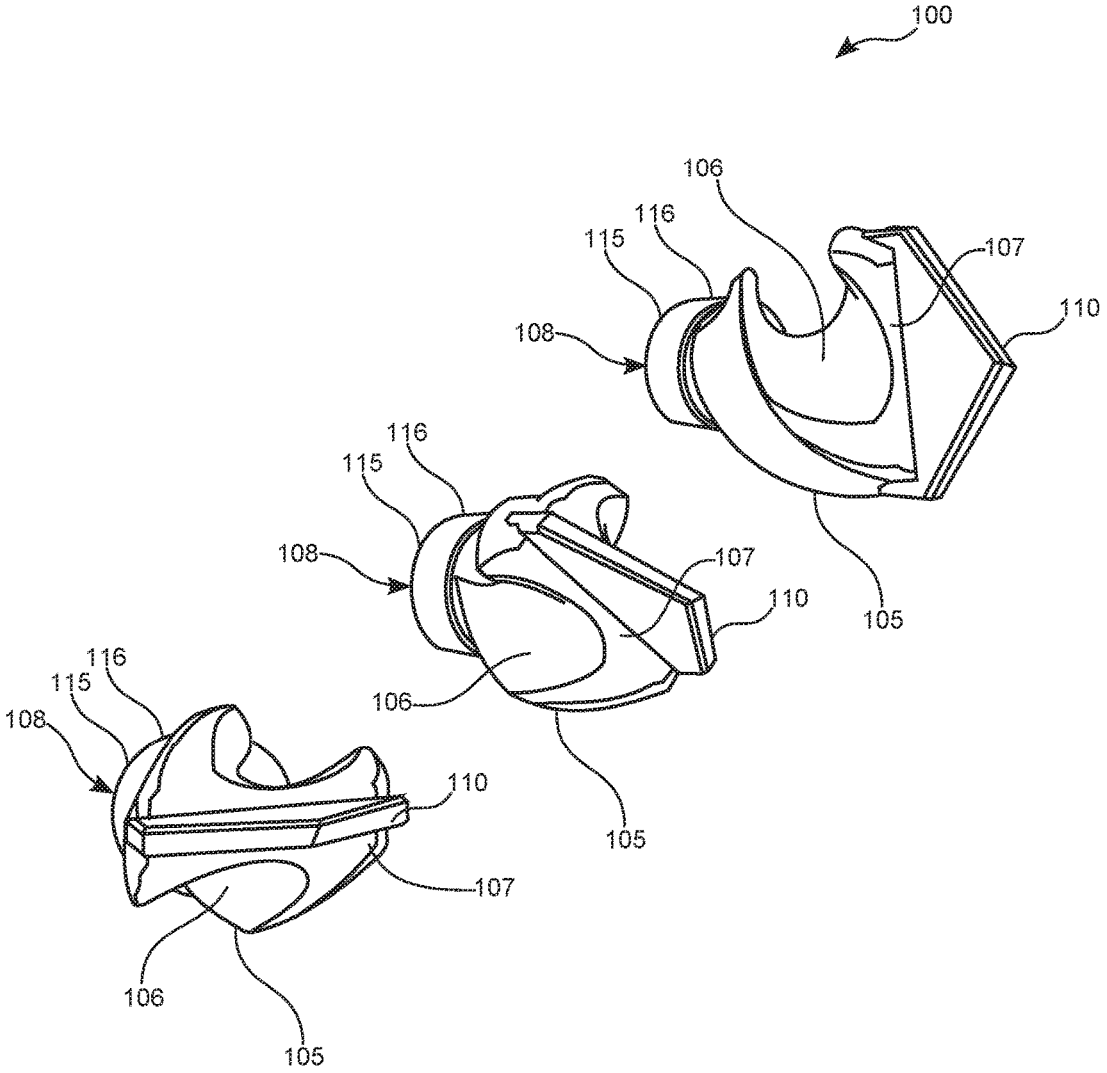
FIG. 1A shows a perspective view illustrating a set of three sizes of an improved drill bit according to an embodiment of the present invention.

In greater detail now, referring to the drawings by numerals of reference there is shown in FIG. 1A, a perspective view illustrating a set of three sizes of improved drill bit 100 according to an embodiment of the present invention.

Improved drill bit 100 for use with sewer pipes 125 may comprise main body portion 105 having spiral groove 106 extending from top end 107 to bottom end 108 of main body portion 105 and is adapted to allow movement of drilled material to move there along and pass rearward away from top end 107 of main body portion 105, blade member 110 connected to top end 107 of main body portion 105 that is adapted to contact and pulverize material, and connector portion 115 connected to bottom end 108 of main body portion 105 that is adapted to releasably attach to end portion 121 of cable sewer snake apparatus 120. Improved drill bit 100 is adapted to be releasably attached to end portion 121 of cable sewer snake apparatus 120 and used to pulverize and remove obstructing material blocking flow through sewer pipe 125.

Figure 1B:
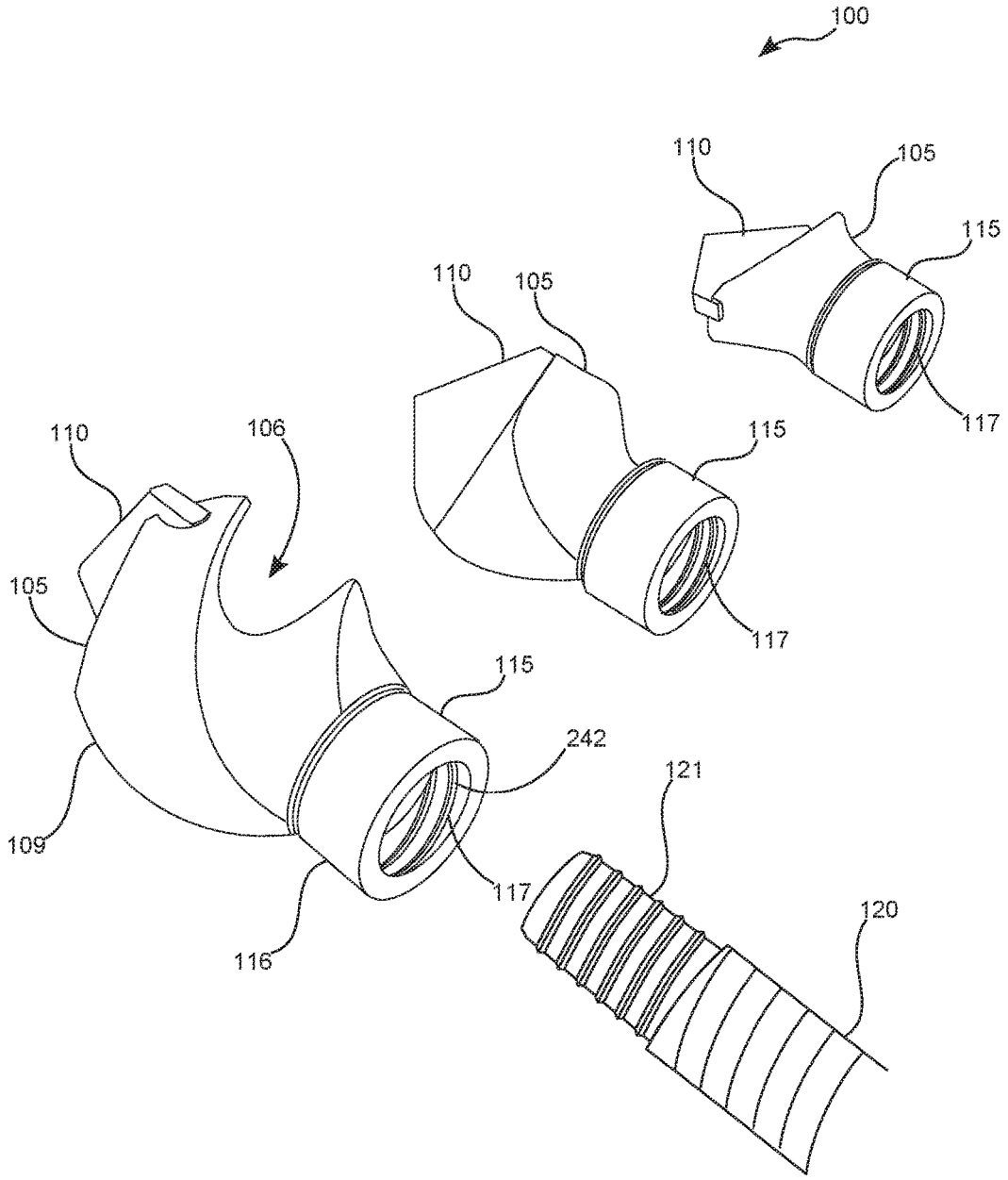
FIG. 1B is a perspective view illustrating the set of three sizes of the improved drill bit according to an embodiment of the present invention of FIG. 1A.

Referring now to FIG. 1B is a perspective view illustrating the set of three sizes of improved drill bit 100 according to an embodiment of the present invention of FIG. 1A.

Connector portion 115 is formed having outer diameter 116 that includes threads 117 upon the surface adapted to interdigitate and releasably connect with threads 117 on end portion 121 of cable sewer snake apparatus 120. Blade member 110 is formed having a diamond-shape having a length and a width and adapted to increase pressure between blade member 110 and material blocking sewer pipe 125. Spiral groove 106 extends around outer periphery 109 of main body portion 105 one time extending from top end 107 to bottom end 108. Spiral groove 106 may extend around the outer periphery of main body portion 105 two times extending from top end 107 to bottom end 108, or may extend around outer periphery 109 three times depending on the embodiment.

Figure 1C:
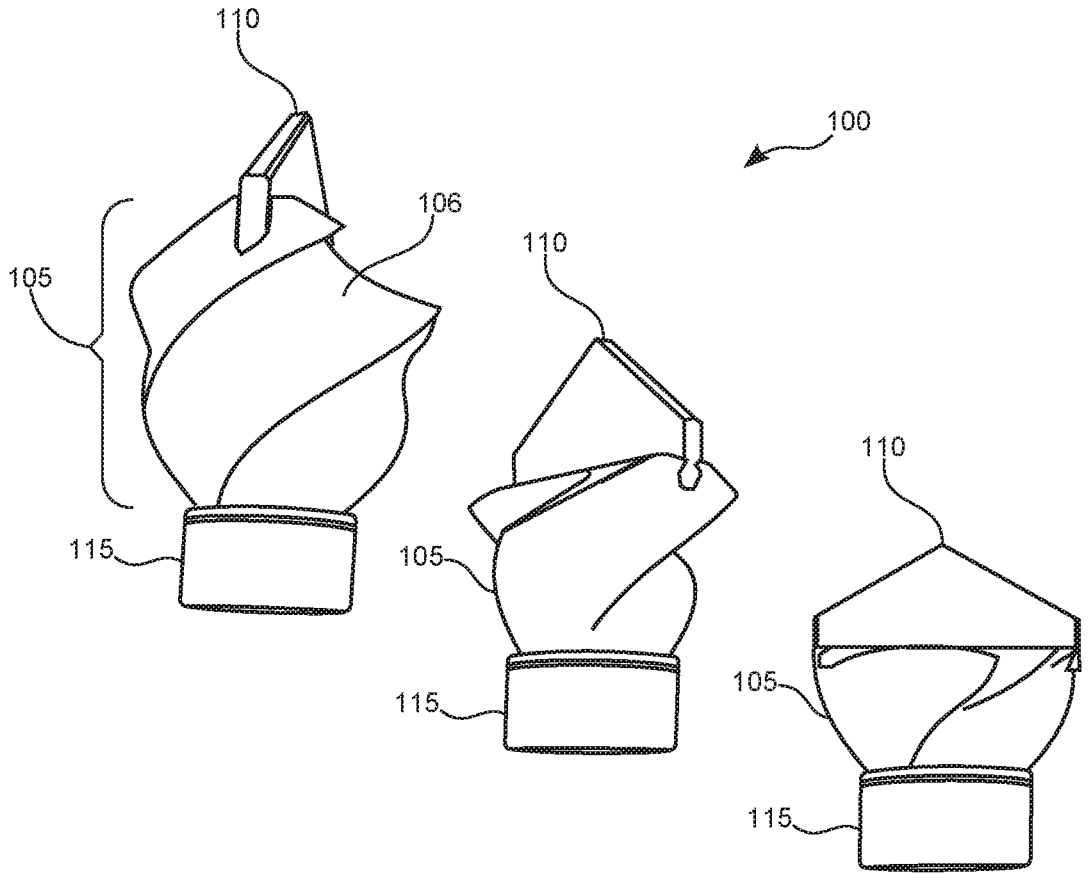
FIG. 1C is a side view illustrating a set of three sizes of the improved drill bit according to an embodiment of the present invention of FIG. 1A.

Referring now to FIG. 1C is a side view illustrating a set of three sizes of improved drill bit 100 according to an embodiment of the present invention of FIG. 1A.

Improved drill bit 100 preferably is offered in a set comprising all embodiments and may be of different diameters for use in different diameters of sewer pipe 125. Main body portion 105 is formed from a material chosen from the group of materials consisting of iron, steel, and ceramic. Blade member 110 is formed from a material chosen from the group of materials consisting of iron, steel, ceramic, and diamonds. Main body portion 105 is formed having outer diameter 116 larger than outer diameter 116 of connector portion 115 and larger than the width and the length of blade member 110.

Figure 2A:
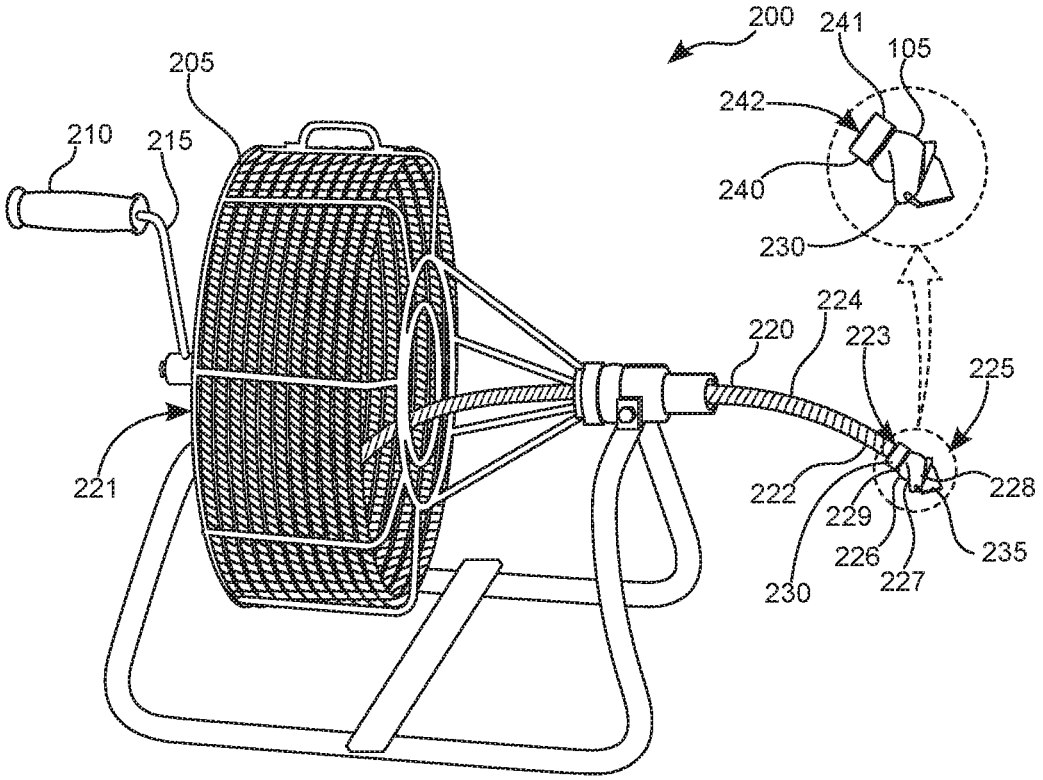
FIG. 2A is a perspective view illustrating an improved cable sewer snake apparatus according to an embodiment of the present invention of FIG. 1A.

Referring now to FIG. 2A is a perspective view illustrating improved cable sewer snake apparatus 200 according to an embodiment of the present invention of FIG. 1A.

Improved cable sewer snake apparatus 200 may comprise casing member 205, handle member 210 attached to casing member 205, crank member 215 rotatably connected to casing member 205, and snake member 220 formed as an elongated and flexible rod-shaped member 224 having an axis defined by its length and adapted to be inserted into sewer pipe 125. Snake member 220 includes first end 221 adapted to extend into casing member 205 and be connected to handle member 210 and rotate therewith and around its axis. Snake member 220 includes an end portion 222 adapted to releasably connect with improved drill bit 225.

Improved drill bit 225 preferably comprises main body portion 226 including spiral groove 227 extending from top end 228 to bottom end 229 of main body portion 226 that is adapted to allow movement of material along spiral groove 227 while drilling, blade member 235 connected to top end 228 of main body portion 226 that is adapted to contact and pulverize material, and connector portion 240 connected to bottom end 229 of main body portion 226 that is adapted to releasably attach to end portion 222 of snake member 220.

Figure 2B:
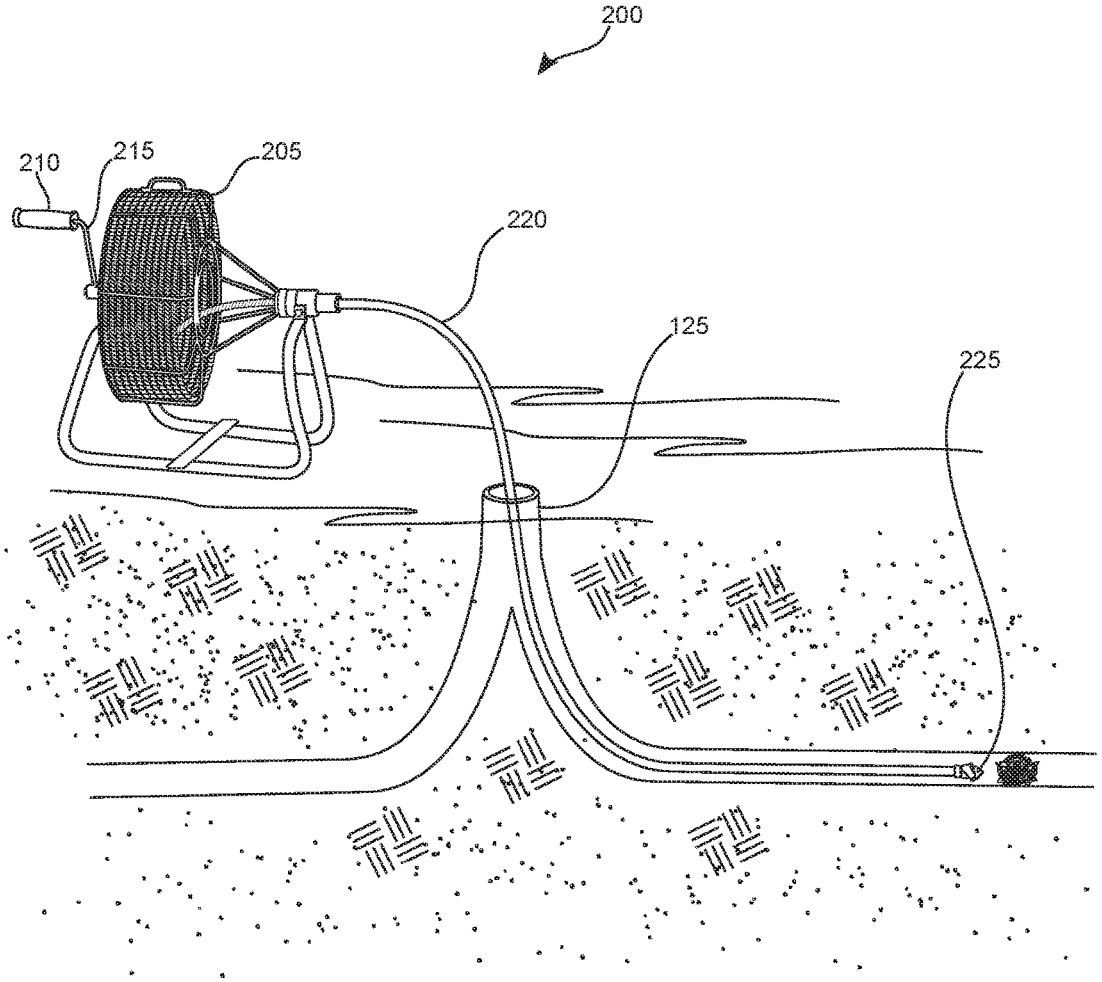
FIG. 2B is a perspective view illustrating an improved cable sewer snake apparatus according to an embodiment of the present invention of FIG. 1A.

Referring now to FIG. 2B is a perspective view illustrating improved cable sewer snake apparatus 200 according to an embodiment of the present invention of FIG. 1A.

Improved drill bit 225 is adapted to be releasably attached to end portion 222 of snake member 220 and used to pulverize and remove material blocking sewer pipe 125 by passing the material along spiral groove 227 away from top end 228 of main body portion 226. End portion 222 of snake member 220 includes threads therein, and connector portion 240 is formed having outer diameter 241 and includes threads 242 upon the surface adapted to interdigitate and releasably connect with threads 223 on end portion 222 of snake member 220.

Blade member 235 is formed having a diamond-shape having a length and a width and adapted to increase pressure between blade member 235 and material blocking sewer pipe 125. Wherein spiral groove 227 extends around outer periphery 230 of main body portion 226 one time while extending from top end 228 to bottom end 229 thereof, but in other embodiments may extend around outer periphery 230 two or three times. Improved drill bit 225 bit preferably is offered in a set comprising all embodiments and may be of different diameters for use in different diameters of sewer pipe 125. Main body portion 226 is formed from a material chosen from the group of materials consisting of iron, steel, and ceramic. Blade member 235 is formed from a material chosen from a group of materials consisting of iron, steel, ceramic, and diamonds. Main body portion 226 is formed having an outer diameter larger than the outer diameter of connector portion 240 and larger than the width and the length of blade member 235.

Upon reading this specification, it should be appreciated that, under appropriate circumstances, considering such issues as design preference, user preferences, marketing preferences, cost, structural requirements, available materials, technological advances, etc., kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved drill bit for use with sewer pipes, comprising:

a main body portion including:

a spiral groove;

wherein said spiral groove extends from a top end to a bottom end of said main body portion and is adapted to allow movement of material there along;

a planar blade member;

wherein said planer blade member has a pair of angled edges at the free end thereof and defining an apex generally centered on the axis of the main body portion, the blade member having a width approximately equal to the diameter of the main body portion at the top end thereof, the blade member is connected to said top end of said main body portion and is adapted to contact and pulverize material; and a connector portion;

wherein said connector portion is connected to said bottom end of said main body portion and is adapted to releasably attach to an end portion of a cable sewer snake apparatus;

wherein said improved drill bit is adapted to be releasably attached to an end portion of a cable sewer snake apparatus and used to pulverize and remove material blocking a sewer pipe.

2. The improved drill bit of claim 1, wherein said connector portion is formed having an outer diameter and includes threads upon a surface thereof adapted to interdigitate and releasably connect with threads on said end portion of said cable sewer snake apparatus.

3. The improved drill bit of claim 2, wherein said blade member is formed having a diamond-shape having a length and a width and adapted to increase pressure between said blade member and material blocking a sewer pipe.

4. The improved drill bit of claim 1, wherein said spiral groove extends around an outer periphery of said main body portion one time while extending from said top end to said bottom end thereof.

5. The improved drill bit of claim 1, wherein said spiral groove extends around an outer periphery of said main body portion two times while extending from said top end to said bottom end thereof.

6. The improved drill bit of claim 1, wherein said spiral groove extends around an outer periphery of said main body portion three times while extending from said top end to said bottom end thereof.

7. The improved drill bit of claim 1, wherein said main body portion is formed from a material chosen from a group of materials consisting of iron, steel, and ceramic.

8. The improved drill bit of claim 1, wherein said blade member is formed from a material chosen from a group of materials consisting of iron, steel, ceramic, and diamonds.

9. An improved cable sewer snake apparatus comprising:

a casing member;

a handle member;

wherein said handle member is attached to said casing member;

a crank member;

wherein said crank member is rotatably connected to said casing member; and a snake member;

wherein said snake member is formed as an elongated and flexible rod-shaped member having an axis defined by its length and adapted to be inserted into sewer pipes;

wherein said snake member includes a first end adapted to extend into said casing member and be connected to said handle member and rotate therewith and around its axis; and wherein said snake member includes an end portion adapted to releasably connect with a bit member; and an improved drill bit comprising:

a main body portion including:

a spiral groove;

wherein said spiral groove extends from a top end to a bottom end of said main body portion and is adapted to allow movement of material there along;

a planar blade member;

wherein said planer blade member has a pair of angled edges at the free end thereof and defining an apex generally centered on the axis of the main body portion, the blade member having a width approximately equal to the diameter of the main body portion at the top end thereof, the blade member is connected to said top end of said main body portion and is adapted to contact and pulverize material; and a connector portion;

wherein said connector portion is connected to said bottom end of said main body portion and is adapted to releasably attach to said end portion of said snake member;

wherein said improved drill bit is adapted to be releasably attached to said end portion of said snake member and used to pulverize and remove material blocking a sewer pipe.

10. The improved drill bit of claim 9, wherein said end portion of said snake member includes threads thereon; and wherein said connector portion is formed having an outer diameter and includes threads upon a surface thereof adapted to interdigitate and releasably connect with said threads on said end portion of said snake member.

11. The improved drill bit of claim 10, wherein said blade member is formed having a diamond-shape having a length and a width and adapted to increase pressure between said blade member and material blocking a sewer pipe.

12. The improved drill bit of claim 9, wherein said spiral groove extends around an outer periphery of said main body portion one time while extending from said top end to said bottom end thereof.

13. The improved drill bit of claim 9, wherein said spiral groove extends around an outer periphery of said main body portion two times while extending from said top end to said bottom end thereof.

14. The improved drill bit of claim 9, wherein said spiral groove extends around an outer periphery of said main body portion three times while extending from said top end to said bottom end thereof.

15. The improved drill bit of claim 9, wherein said main body portion is formed from a material chosen from a group of materials consisting of iron, steel, and ceramic.

16. The improved drill bit of claim 9, wherein said blade member is formed from a material chosen from a group of materials consisting of iron, steel, ceramic, and diamonds.

* * * * *